US007513714B2

(12) United States Patent
Green

(10) Patent No.: US 7,513,714 B2
(45) Date of Patent: Apr. 7, 2009

(54) REMOVABLE DRIVING TABS FOR A VIBRATORY CAISSON

(75) Inventor: Todd J. Green, Olive Branch, MS (US)

(73) Assignee: Thomas & Betts International, Inc., Wilmington, DE (US)

( * ) Notice: Subject to any disclaimer, the term of this patent is extended or adjusted under 35 U.S.C. 154(b) by 377 days.

(21) Appl. No.: 11/471,884

(22) Filed: Jun. 21, 2006

(65) Prior Publication Data

US 2007/0297859 A1 Dec. 27, 2007

(51) Int. Cl.
*E02D 7/18* (2006.01)

(52) U.S. Cl. ..... 405/232

(58) Field of Classification Search ..... 405/232, 405/249, 255, 231, 229
See application file for complete search history.

(56) References Cited

U.S. PATENT DOCUMENTS 3,686,877 A * 8/1972 Bodin ..... 405/249
3,783,954 A * 1/1974 Bodine ..... 173/49
3,998,063 A * 12/1976 Harders ..... 405/231
4,174,093 A * 11/1979 Shearer ..... 254/29 R
4,472,085 A * 9/1984 Mohler ..... 405/255
5,544,979 A * 8/1996 White ..... 405/232
5,653,556 A * 8/1997 White ..... 405/249
6,648,556 B1 * 11/2003 White ..... 405/249
6,672,805 B1 * 1/2004 White ..... 405/232
2005/0232708 A1 * 10/2005 White ..... 405/249
2006/0088388 A1 * 4/2006 Wissmann et al. ..... 405/232

* cited by examiner

*Primary Examiner*—Frederick L Lagman
(74) *Attorney, Agent, or Firm*—G. Andrew Barger

(57) ABSTRACT

A pair of removable driving tabs are provided for a base plate that has at least two opposing apertures disposed therein. Each of the removable driving tabs are gripped by a machine for vibrating each of the pair of removable driving tabs. The driving tabs are releasably secured to a base plate that is mounted on a caisson. When the driving tabs are vibrated by the machine, the vibration is transferred through the base plate and into the caisson, which is vibrated into the ground for installation.

16 Claims, 5 Drawing Sheets

REMOVABLE DRIVING TABS FOR A VIBRATORY CAISSON

FIELD OF THE INVENTION

In general, the present invention relates to vibratory caissons and, in particular, the present invention relates to at least one removable tab for a vibratory caisson.

BACKGROUND

Structural caissons are typically installed in the ground by vibration. Once installed in the ground the caissons provide a sturdy base for mounting other structural members thereon such as tapered steel poles or a foundational platform. A base plate is typically welded to the top of each caisson and has a plurality of apertures disposed therein for mounting another base plate thereon with matching apertures that is attached to a tapered steel pole or a foundational platform. Threaded bolts are installed in the matching apertures of the mating base plates and nuts are used to secure the sandwiched base plates together. Currently, the base plate steel material is radially increased by four inches on opposing sides so that a driving tab or ear can be welded onto the base plate. Upon installation of the caisson, a vibrating machine clasps the driving tabs and vibrates the caisson into the ground. Such integral driving ears are undesirable since they cannot be removed and reused. The integral driving tabs offer no protection against slippage of the machine gripping mechanism, which can slip downward and scratch the base plate. This can damage the base plate and increase the onset of oxidation of the base plate especially if the base plate is galvanized and the zinc coating is scratched or chipped off. The integral driving tabs are aesthetically displeasing and make it more difficult to install the threaded bolts into the matching apertures for the upper flange plate connection. Further, the additional radial width that must be added onto the base plate increases material, structural weight and shipping costs. Moreover, the current integral driving ears have no coarse gripping surface to prevent slipping of the driving machine when gripping the ears of the driving tabs. Last, there is no way to prevent lateral slippage of the driving machine when it clasps the ears to thereby prevent the driving machine from becoming disengaged from the driving tabs during operation.

SUMMARY OF THE INVENTION

The present invention eliminates the above difficulties and disadvantages by providing a pair of removable driving tabs for a base plate with at least two apertures disposed therein. Each of the removable driving tabs is gripped by a vibratory machine for vibrating each of the pair of removable driving tabs. The driving tabs are releasably secured to the base plate that is mounted on the caisson and can be reused for multiple caisson installations. When the machine vibrates the driving tabs, the vibration is transferred through the base plate and into the caisson, which is vibrated into the ground for installation. Each of the pair of removable driving tabs comprises an ear and a flange secured to the ear. A threaded bolt is secured to the ear and the flange. A lock washer is provided for inserting over the bolt and at least one nut for threading onto the bolt. During installation the bolt of each removable driving tab is inserted through one of the opposing apertures of the base plate such that the flange abuts the top surface of the base plate. Each driving tab is then releasably secured to the base plate when the lock washer is inserted over the bolt such that the lock washer abuts the bottom surface of the base plate, and at least one nut is threaded onto the bolt until it abuts the lock washer. Further, a coarse gripping surface is included on the ears of the driving tabs to prevent machine slippage. In one embodiment each flange is U-Shaped such that the flanges extend axially away from the base plate and adjacent the ears to prevent lateral disengagement of the machine, via slippage, when vibrating the ears. The flange prevents the gripping machine from contacting the base plate.

DETAILED DESCRIPTION OF THE PREFERRED EMBODIMENT(S)

Figure 1:
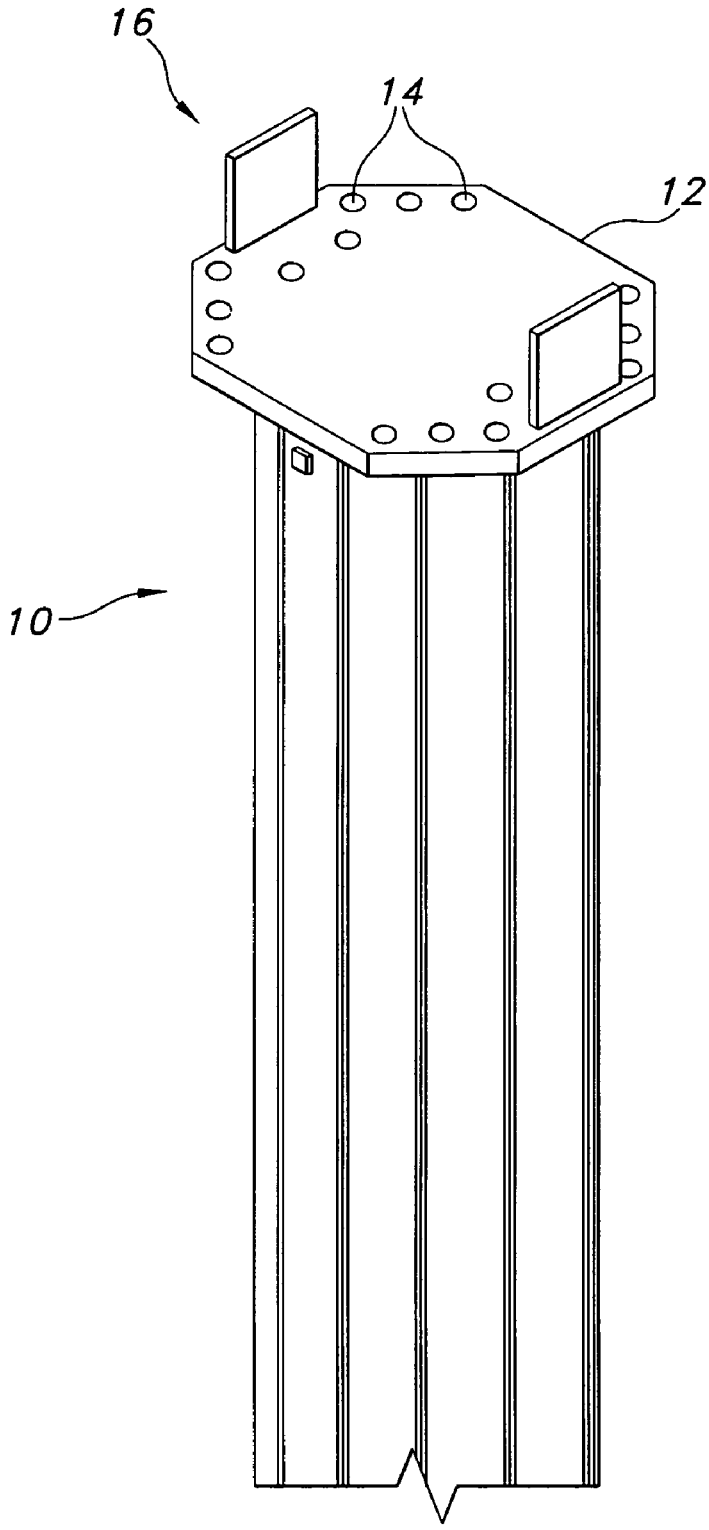
FIG. 1 (Prior Art)
FIG. 1 is a perspective view of a prior art caisson with integral driving tabs.
Figure 2:
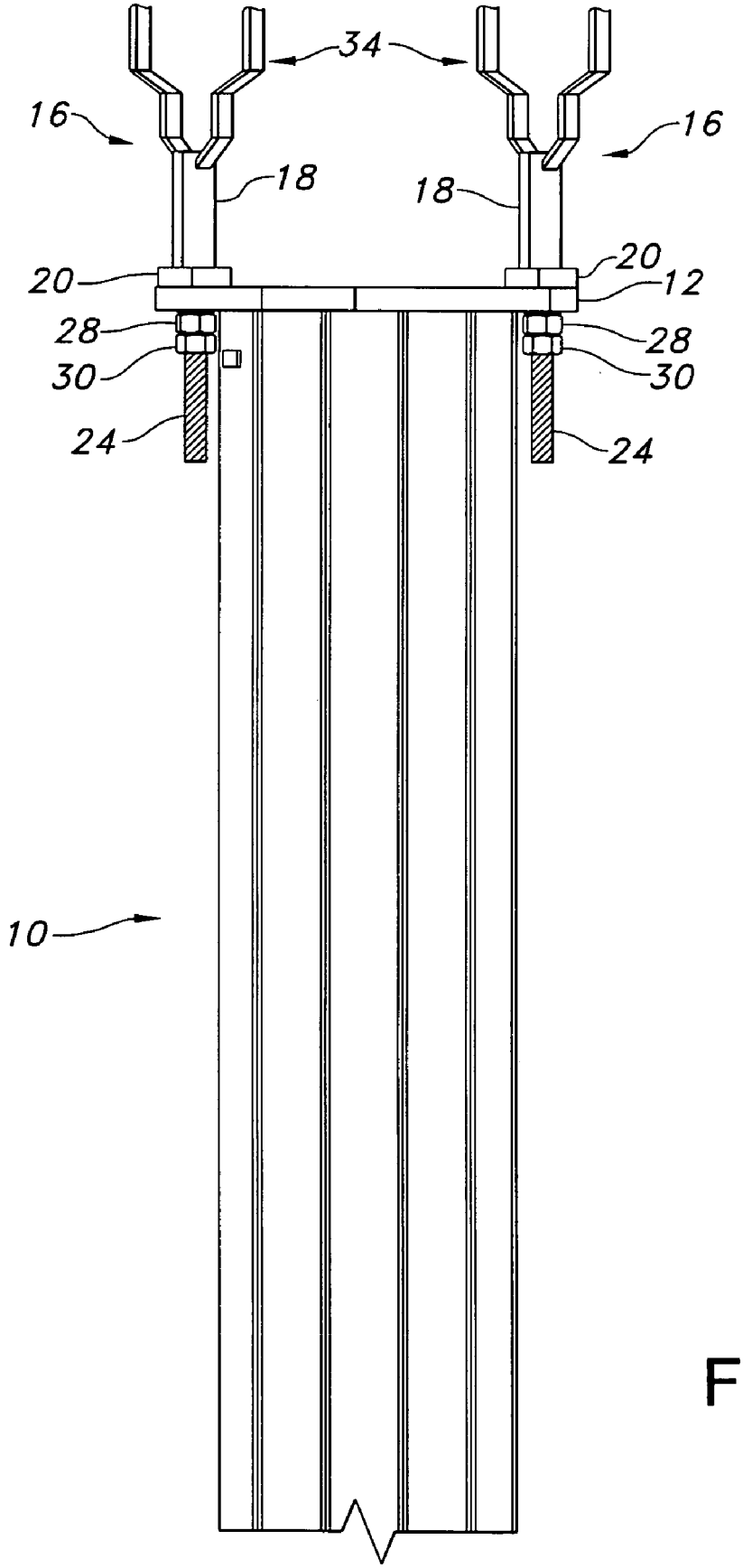
FIG. 2 is a perspective view of a caisson with removable driving tabs of the present invention.

The above and other features, aspects, and advantages of the present invention will now be discussed in the following detailed description of preferred embodiments and appended claims, which are to be considered in conjunction with the accompanying drawings where identical reference characters designate like elements throughout the views. Shown in prior art FIG. 1 is a structural member, which is preferably a steel caisson 10 that is vibrated into the ground during installation. The polygonal caisson 10 serves as foundational support for another structural member such as an electrical transmission pole or an offshore oil-drilling platform. A base plate 12 is welded to the caisson 10 and contains a plurality of apertures 14. When the upper structural member is mounted on the base plate 12, a mating surface, such as another base plate, abuts base plate 12 and threaded bolts are inserted through matching apertures in the mating surface that aligns with apertures 14. Nuts are then screwed onto the bolts to secure the mating surfaces together. Prior to securement of the mating surfaces, the caisson 10 is vibrated into the ground by a machine 34 as shown in FIG. 2. In order for this to occur, the machine 34 must have tabs 16 in which to grip. In the prior art these tabs are welded onto the base plate 12, but first, the base plate 12 must be radially expanded typically by an extra four inches of steel material that extends beyond apertures 14.

Figure 3:
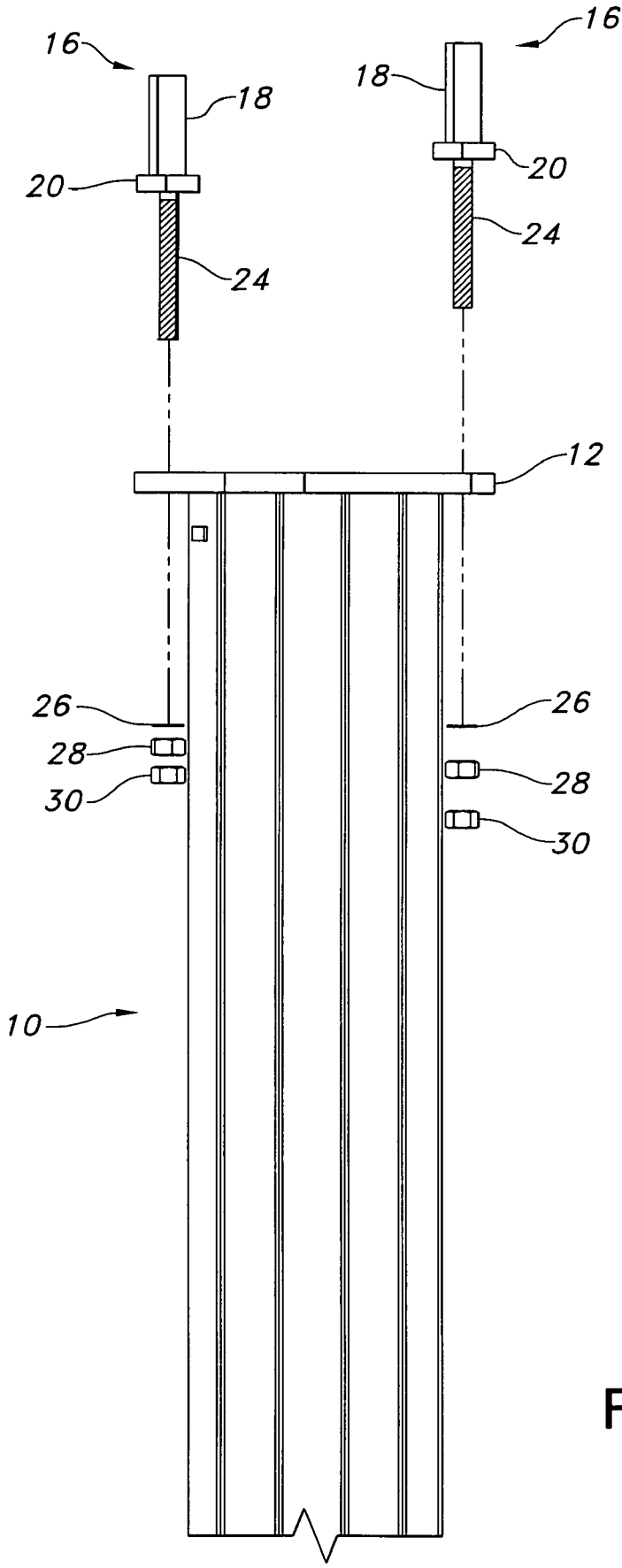
FIG. 3 is a perspective view of a caisson with an exploded view of the removable driving tabs of the present invention.
Figure 4:
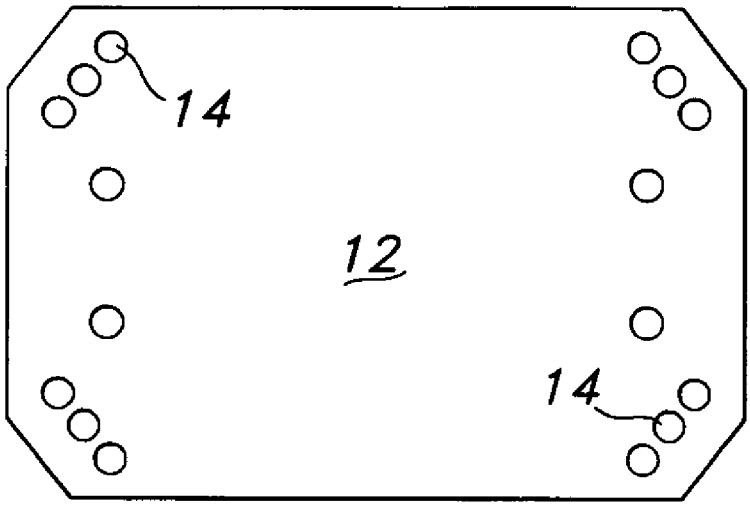
FIG. 4 is a plan view of a caisson base plate of the present invention without the removable driving tabs installed.
Figure 5:
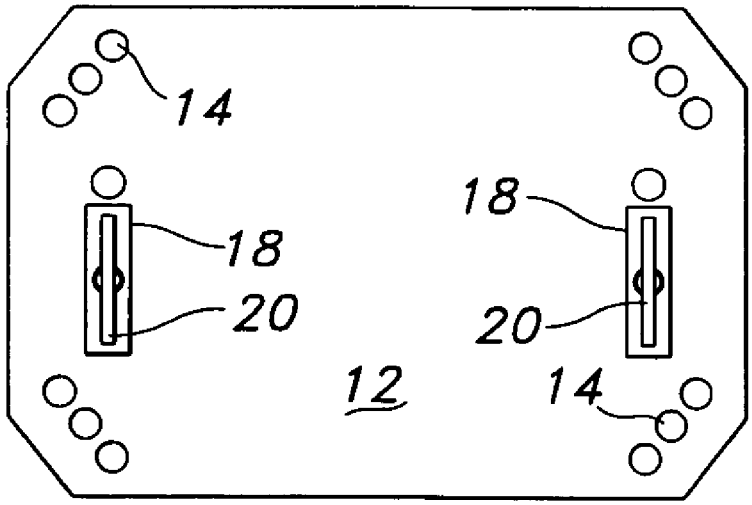
FIG. 5 is a plan view of a caisson base plate of the present invention with the removable driving tabs installed.

Referring now to the present invention shown in FIGS. 2-9, a pair of removable driving tabs 16 are displayed for releasably securing to base plate 12. The driving tabs 16 are preferably constructed of metal, such as steel, for durability. As is best shown in FIGS. 4-5, the base plate 12 of the present invention has a plurality of apertures 14 for receiving bolts therethrough for a mating surface, such as another base plate. Two opposing apertures 14 are used in the present invention to releasably secure the driving tabs 16 therein as will be discussed in further detail below. It can also be seen that additional steel has been removed from base plate 12 that was present in the prior art base plate shown in FIG. 1, thus saving material cost and shipping weight.

As is best shown in FIGS. 3 and 6-8, each of the pair of removable driving tabs 16 includes an ear 18 that is generally square in shape and one inch thick, but could be any variation of shape that can be gripped by the vibratory machine 34. In the preferred embodiment a flange 20 is secured to the ear 18 and in perpendicular arrangement thereto by twenty-four inches of pen weld. The flange 20 is also generally rectangular in shape, but could be any variation of shape that will prevent the vibratory machine 34 from impacting the base plate 12 and chipping or scratching the surface of base plate 12. The flange 20 is also preferably made of a durable material such as steel.

Figure 6:
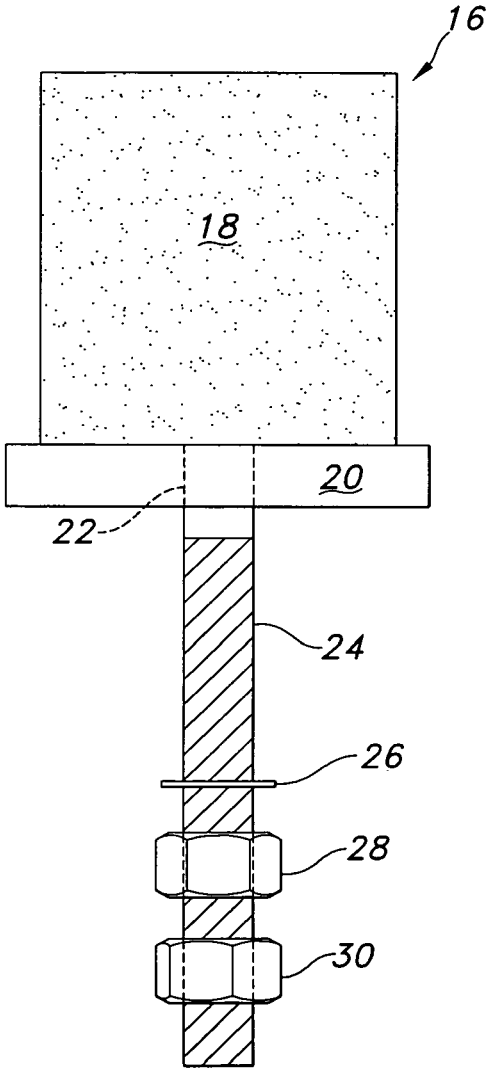
FIG. 6 is a front elevational view of the removable driving tab of the present invention.
Figure 7:
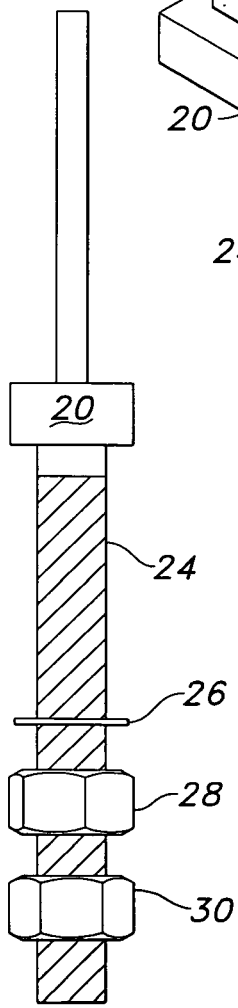
FIG. 7 is a side elevational view of the removable driving tab of the present invention.
Figure 8:
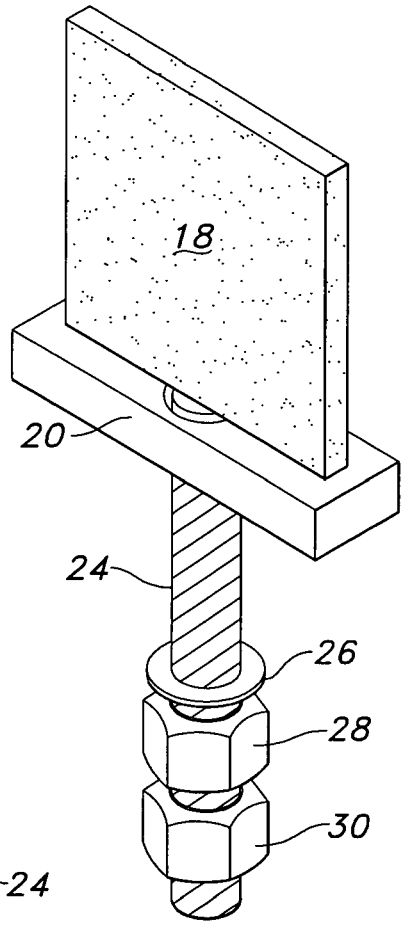
FIG. 8 is a perspective view of the removable driving tab of the present invention.

As best shown in FIG. 6, an aperture 22 is disposed in flange 20 and extends therethrough. During manufacture of each tab 16, a bolt 24, which is at least partially threaded, is inserted into aperture 22 of the flange 20. The bolt 24 is preferably constructed of #18 jumbo rebar manufactured by Gerdau Ameristeel having an office at 4221 West Boy Scout Blvd., Suite 600, Tampa, Fla. 33607. The aperture 22 could be threaded and the bolt 24 can be screwed into aperture 22. Preferably, however, the bolt 24 is not threaded along the length that is received in aperture 22. When in place within aperture 22, the bolt 24 is secured to the ear 18 and the flange 20 by welding such that aperture 22 is filled with molten solder. Since the aperture extends through flange 20, the molten solder is able to reach ear 18, thereby securing it to the bolt 24 and flange 20 once cooled.

Figure 9:
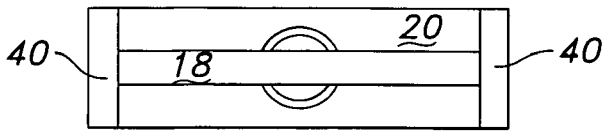
FIG. 9 is a plan view of the removable driving tab of the present invention showing a U-shaped flange.

In this arrangement, the machine 34 is prevented from laterally disengaging from ear 18 when vibrating each tab 16. As shown in FIG. 9, the flange 20 can also have a U-shaped cross section such that it extends upward and perpendicular to sidewalls of ear 18. A large amount of vibrational force is needed to vibrate a structure, such as caisson 10, that can weigh thousands of pounds, into the ground. To prevent the machine 34 from vibrating laterally off the ear 18, the flange 20 is generally U-shaped such that machine 34 cannot vibrate off either side of the ear 18. In addition, the planar extension of the flange 20 that abuts the base plate 12, prevents the machine 34 from vibrating axially downward and against the base plate 12. If such contact does occur, the surface of the base plate 12 can be damaged and any surface layer, such as paint or zinc galvanizing, can be damaged or removed from the base plate 12. This type of damage is prevented in the present invention. To additionally aid in gripping ear 18 by the machine 34, the surface of the ear 18 is preferably coarse, as shown in FIGS. 2, 3, 6-8. The surface of ear 18 can also be scored or lined with a plurality of ridges. Since each ear 18 is preferably comprised of metal, forming a gripping surface on the metal increases the gripping force of machine 34 to prevent slippage in both the lateral and longitudinal directions when the machine 34 is vibrating the driving tab 16.

Assembly of each driving tab 16 to base plate 12 is shown in FIGS. 2 and 3, with the later showing a fully assembled view of the tabs on the base plate 12. First, the bolt 24 is inserted through one of the apertures 14 in the base plate 12. The bolt 24 is preferably threaded rebar material, but can be any bolt of sufficient diameter and durable material. The other bolt 24 of the other tab 16 is inserted through one of the apertures 14 that is opposite the first aperture of the first tab 16. It does not matter which two apertures 14 are used since the tabs 16 will be removed from the base plate 12 before another structure is installed on top of the base plate 12.

Once the bolts are installed through the base plate apertures 14 and the flanges are positioned so that they abut the top surface of the base plate 12, a lock washer 26 is provided for inserting over each of the bolts 24. Next, at least one nut, but preferably a first nut 28 and a second nut 30, are threaded onto each bolt 24 until the first nut 28 tightly presses the lock washer 26 against the bottom surface of the base plate 12. The second nut 30 is then screwed up the bolt 24 such that it abuts the first nut 28, as shown in FIG. 2.

By using this nut and washer combination, each driving tab 16 is releasably secured to the base plate 12 such that the driving tabs 16 can be reused when a different caisson 10 is installed into the ground. To release each driving tab 16, the second nut 30 and first nut 28 are unscrewed from bolt 24, respectively. Next the lock washer 26 is slid down the bolt 24. The driving tab 16 is then lifted off the base plate 12 and the bolt 24 is removed from the base plate apertures 14.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

What is claimed is:

1. A pair of removable driving tabs for a base plate, each of the pair of removable driving tabs being gripped by a machine for vibrating each of the pair of removable driving tabs, which comprise:

an ear; and a U-shaped flange secured to the ear for preventing the machine from contacting the base plate and preventing lateral disengagement of the machine from of the pair of removable driving tabs when vibrating each of the pair of removable driving tabs.

2. The pair of removable driving tabs for a base plate of claim 1 wherein the pair of removable driving tabs further comprise a lock washer.

3. The pair of removable driving tabs for a base plate of claim 2 wherein the pair of removable driving tabs further comprise at least one nut for releasably securing the lock washer to the base plate.

4. A pair of removable driving tabs for a base plate having a top surface, a bottom surface, and at least two apertures disposed therein, each of the pair of removable driving tabs being gripped by a machine for vibrating each of the pair of removable driving tabs, which comprise:

an ear;

an at least partially threaded bolt secured to the ear;

at least one nut for threading onto the bolt; and wherein during installation, the bolt of each removable driving tab is inserted through one of the at least two apertures of the base plate such that the ear abuts the top surface of the base plate, and the at least one nut is threaded onto the bolt such that each of the pair of removable driving tabs is then releasably secured to the base plate.

5. The pair of removable driving tabs of claim 4 further comprising a flange secured to the ear.

6. The pair of removable driving tabs of claim 5 wherein the at least partially threaded bolt is secured to the flange such that the flange abuts the top surface of the base plate when the bolt of each removable driving tab is inserted through one of the at least two apertures of the base plate.

7. The pair of removable driving tabs of claim 5 further comprising a lock washer for inserting over the bolt.

8. The pair of removable driving tabs of claim 7 wherein during installation the lock washer is inserted over the bolt such that the lock washer abuts the bottom surface of the base plate and is disposed between the bottom surface of the base plate and the at least one nut.

9. The pair of removable driving tabs of claim 4 wherein the ear further includes a coarse gripping surface.

10. The pair of removable driving tabs of claim 5 wherein the flange is U-Shaped such that it extends axially away from the base plate and adjacent the ear to prevent disengagement of the machine when vibrating the ear.

11. A pair of removable driving tabs for a base plate having a top surface and a bottom surface, the base plate also having at least two opposing apertures disposed therein, each of the pair of removable driving tabs for gripping by a machine and vibrating each of the pair of removable driving tabs, which comprise:

an ear;

a threaded bolt secured to the ear;

a lock washer for inserting over the bolt;

at least one nut for threading onto the bolt; and wherein during installation, the bolt of each removable driving tab is inserted through one of the opposing apertures of the base plate such that the ear abuts the top surface of the base plate, then the lock washer is inserted over the bolt such that the lock washer abuts the bottom surface of the base plate, and the at least one nut is threaded onto the bolt until it abuts the lock washer such that each of the pair of removable driving tabs is then releasably secured to the base plate.

12. The pair of removable driving tabs for a base plate of claim 11 further comprising:

a flange secured to the ear; and wherein during installation the bolt of each removable driving tab is inserted through one of the opposing apertures of the base plate such that the flange abuts the top surface of the base plate, and each driving tab is then releasably secured to the base plate when the lock washer is inserted over the bolt such that the lock washer abuts the bottom surface of the base plate, and the at least one nut is threaded onto the bolt until it abuts the lock washer.

13. The pair of removable driving tabs of claim 11 wherein the ear further includes a coarse gripping surface.

14. The pair of removable driving tabs of claim 12 wherein the flange is U-Shaped such that it extends axially away from the base plate and adjacent the ear to prevent disengagement of the machine when vibrating the ear.

15. The pair of removable driving tabs of claim 11 wherein the ear further includes a score gripping surface.

16. The pair of removable driving tabs of claim 11 wherein the ear further includes a griping surface of ridges.

* * * * *